United States Patent [19]

Burczynski

[11] Patent Number: 4,550,662

[45] Date of Patent: Nov. 5, 1985

[54] EXPANDING PROJECTILES

[76] Inventor: Thomas J. Burczynski, 508 Johnson Hollow Rd., R.D. 1, Millport, N.Y. 14864

[21] Appl. No.: 902,487

[22] Filed: May 3, 1978

[51] Int. Cl.[4] ..... F42B 11/10

[52] U.S. Cl. ..... 102/509

[58] Field of Search ..... 102/91, 92.1, 92.2, 102/92.3, 92.4, 501, 507–510

[56] References Cited

U.S. PATENT DOCUMENTS 3,157,137 11/1964 Burns, Jr. ..... 102/91

4,044,685 8/1977 Avcin ..... 102/91

FOREIGN PATENT DOCUMENTS 4426 of 1899 United Kingdom ..... 102/91

14717 of 1900 United Kingdom ..... 102/91

*Primary Examiner*—Harold J. Tudor

*Attorney, Agent, or Firm*—Frank B. Robb

[57] ABSTRACT

There is disclosed a bullet or projectile, which may be fired by a wide variety of guns or other means, with improved accuracy and impact shock, and of a form embodying a generally conventional exterior configuration but having a hollow-point construction including ribs and flutes in the hollow portion which are formed to increase the hydraulic effects of entry into a fluidic target with more complete, uniform flattening and reaming action without reduction in accuracy.

9 Claims, 5 Drawing Figures

EXPANDING PROJECTILES

BACKGROUND OF THE INVENTION

The concept of hollow-point or mushroom type bullets, is known, and in my prior U.S. Pat. No. 3,881,421, there is disclosed a hollow-point bullet of improved form, which includes an annular trench or channel with a blunt nose therewithin, a center-piece of substantial mass formed within the body, and in fact providing improved action over prior bullets, but nevertheless not the type of action which is provided by the instant concept as disclosed herein. The hydraulic impact and effects were indeed improved but not to the extent of the present concept as disclosed.

Other patents such as that of Burns, Jr., U.S. Pat. No. 3,157,137, also disclose and in this particular instance a hollow-point bullet but relies on the fracturing and flattening from scored and folded areas in the jacket of the bullet rather than from any improved action developed by reason of the type of target or hydraulic or other means incorporated therein and not involving a type of action which is developed in the current invention of my disclosure.

Other concepts such as that of Rousseau, disclose hollow-point construction but the fracturing takes place upon impact in a jagged manner, and does not concentrate the shock or hydraulic effect to multiply the same and effect the desired concentration for ultimate result as is true in my new bullet.

There are other designs of hollow-point bullets but these foregoing just described represent typical concepts though not more than generally related to that hereinafter to be described.

OBJECTS OF THE INVENTION

It is a principal object of this invention to provide a bullet of the hollow-point or mushroom type, whether jacketed or un-jacketed or semi-jacketed, which can be formed by casting without difficulty other than would normally be expected, to produce a bullet, which is suitable for relatively low velocity, even as much as 750 feet per second but preferably not lower than 850 feet per second and which can range upwardly to 4,000 feet per second or higher, while exhibiting extreme accuracy and adequate penetration providing more powerfurl impact shock than has been obtained previously with such bullets.

A further object of this invention is to provide in a hollow-nose or hollow-point type of bullet, a cavity which is of different form than those heretofore proposed, involving a generally frusto conical form and having therewithin suitable ribs and flutes, formed to take advantage of the fluid flowing thereinto upon impact with a fluidic target, to effect expansion rapidly, so that the ultimate shock generated, is generated quickly and humane taking of game or the like results.

Another object of this invention is to positively increase the expansion of the hollow-point bullet, and thereby the shock imposed, without unduly increasing the width of the frontal opening at the nose of the bullet eventhough availing of a substantially deep cavity.

A further object of the invention is to maintain the necessary central mass in a bullet of the character described, so that stable flight is possible and effected, and that no structural weakening of the hollow-point takes place which would leave the bullet susceptible to adverse terminal behavior, reducing the tendency of the bullet to shear during its expanding operation when impacting a fleshy target which shearing would reduce the overall effectiveness thereof.

A further object of this invention is to provide an improved bullet which involves the use of multiple wedge shaped ribs within the nose ogive area which maintains the central mass desired for stability and prevents disintegration or adverse shearing after impact and penetration. The expanding action is materially increased by the fluting which is provided between the control ribs and thus in turn facilitates rapid expansion.

The other objects and advantages of my new invention are disclosed in the specification appended hereto and shown in the drawing wherein.

Figure 3:
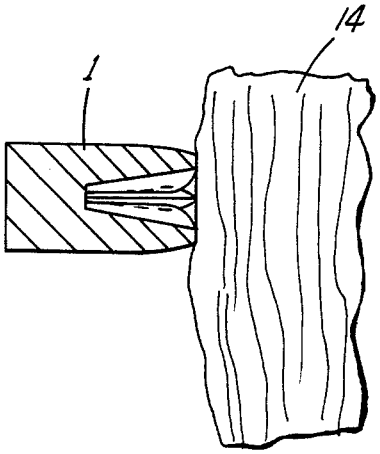
Figure 4:
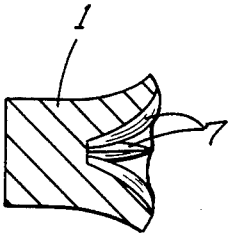
Figure 5:
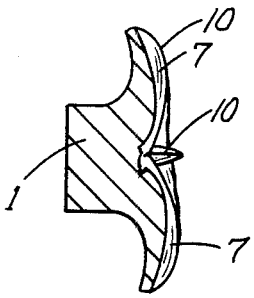

FIGS. 3,4, and 5 illustrate the bullet in its transition from initial contact with a fleshy target, in FIG. 3, FIG. 4 as partly expanded therewithin and FIG. 5 as fully expanded in its ultimate disposition.

DESCRIPTION OF THE INVENTION

Figure 1:
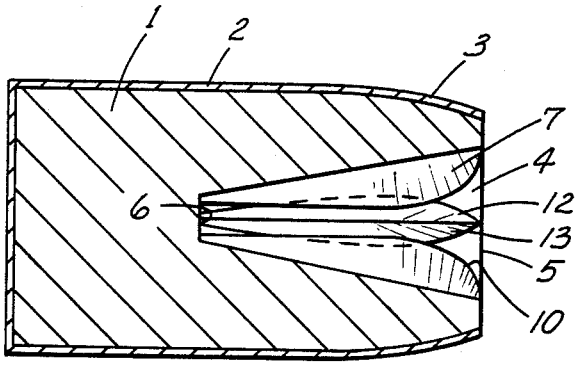
FIG. 1 is a vertical sectional view through a bullet constructed in accordance with this invention.

Referring to FIG. 1, there is disclosed a bullet generally denoted 1, which for the purposes hereof is intended to represent a pistol bullet, including the body 1 thereof and jacketed by means of the jacket 2 in conventional fashion, the ogive area being designated at 3, and including therewithin, a cavity generally designated 4, which cavity provides an enlarged opening at 5, with the bottom or inner-end designated 6.

Figure 2:
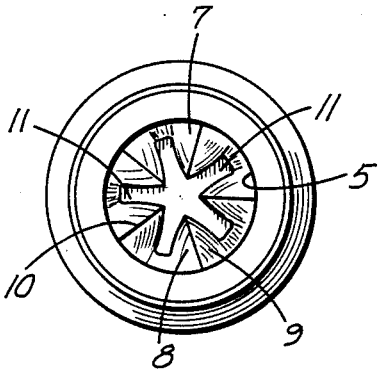
FIG. 2 is an end view looking toward the opening in the point of the bullet.

It will be observed that this cavity 4 is thus a frusto conical cavity generally speaking, as to its basic outline, the cavity in turn however being equipped with a series of what may be termed tapered wedges or rib members in this instance designated 7, there being disclosed as will be observed from FIG. 2, five of these members 7 spaced within the cavity 4 and uniformly arranged as shown. While five rib members are here shown, as few as three may be used under some conditions without adversely affecting the results attained hereby.

It will be seen that these rib members, are in fact wedges, and involve the generally triangular configuration as viewed in FIG. 2, including the sides 8 and 9 in each case, all of the ribs being identical, and having as a result a triangular appearance, in which the apex of the triangle, provides an apical line designated 10, this apical line 10 being continuous from the opening 5 to the bottom or end 6.

This apical line becomes the edge of the wedge so to speak, and as such as viewed in FIG. 1, is generally parallel or substantially parallel to the axis of the cavity 4.

The provision of the wedge shaped arrangement involving these ribs, is such as to in turn form flutes which for the purposes hereof are designated 11 and occupy the space between the respective ribs or wedges 7 for purposes which will be understood as this description proceeds.

The ribs or wedges 7 are further described as being of diminishing area as viewed from the end, and as shown in FIG. 1 likewise, as the ribs extend inwardly so that the triangular area a short distance from the opening of the cavity is substantially greater than the triangular area at the end or bottom of the cavity 6.

It should be noted at this point that the cavity in a rifle bullet, formed according to my concept, is desirably one which extends not less than 1/5 of the overall length of the body of the bullet, and may extend as much as ½ thereof without adversely affecting the bullet's operation, and in fact enhancing the same as will be understood from this description.

The pistol bullet shown in FIG. 1, is provided with a cavity 4 which is not less than ⅓ of the overall length of the body of the bullet, and may be as much as possibly ⅔ such length without adversely affecting its trajectory or accuracy in actual use.

In considering the configuration of the ribs or rib members 7 otherwise denoted as wedges or wedge-like parts, it should be pointed out that the apical edges are arranged as disclosed in FIG. 1 so as to have a gently curving initial section at the opening of the cavity, and thereafter becoming straight to the bottom thereof.

It is further noted that the rib members or wedges 7 are integral with the body 1 and formed at the time of manufacture thereof so as to be integral and incorporate therein the gently curved surfaces suggested at 12 and 13 at the entry or at the opening 5 so that the action of impacting will be emphasized as the fluid passes around these surfaces, and vents into the cavity 4 thereafter.

It will be seen that the position of the respective parts in FIG. 3 upon initial contact with flesh such as is denoted at 14, indicates the initial position of the bullet and in FIG. 4 as being partly within the fleshy area of 14 in an enlarged condition with the fluted section involving the ribs and ogive portion of the bullet partially expanded, and in FIG. 5 fully expanded and flattened so as to create its maximum impact and shock and ultimate purpose in use.

It is noted that since the bullet will be spinning in flight, and entry into the fleshy parts that the action of these ribs or wedges 7 is one which might be termed a reaming action and will thereby increase the hemorrhaging effect and ultimate impact value and purpose of using the bullet in any event.

It may be pointed out that the manufacture of these bullets can be effected in a single operation by swaging die, with a specially grooved nose punch to form the longitudinal flutes therein, and the surfaces of the ribs which taper inwardly from the nose toward the base of the cavity 6.

The wide upper section of the ribs 7, may terminate at a point within the interior wall of the ogive, where it is proportioned so that the inside edge of the mouth of the opening 5, leaves some soft lead exposed at the nose of the bullet to allow a more rapid expansion when the bullet impacts the target. While the ribs 7 terminate well within the nose, there is still substantial and sufficient hydraulic pressure directed to the walls of the flutes to cause rapid radial expansion of the bullet and a consequent wound channel of devastating effect. The V-shape of the inner walls of the ogive, as viewed in FIG. 1 in section, enhances the opening action, to cause the target to absorb the maximum energy developed, the opening taking place in such a short period of time after impact that the ultimate effect is one which takes place sooner than would otherwise be the case with the usual bullet of this general character.

As a matter of fact the expansion of the control area of the bullet which is described as including the ribs and flutes 7 and 11, is substantially circular in form and of very wide scope tending to ream the flesh ahead of the expanding ogive as heretofore suggested.

It may be desirable to vary the thickness of the jacket of this bullet, with core temper likewise varying to govern the degree and rapidity of expansion for use under varying conditions of special nature.

It is noted that repeated test firings of bullets made in accordance with the foregoing, have in fact established and fully confirmed the accuracy and effectiveness thereof in use as compared with prior known bullets.

Although the specific details of the invention have been shown as being of one particular form, variation in such form within the scope of the appended claims are contemplated hereby.

I claim:

1. A bullet having a central body of malleable material including an ogival end in which is provided an integral open cavity of generally frusto-conical form, a series of rib members extending longitudinally and radially inwardly in said cavity, integral with the body and spaced circumferentially therein, said rib members being formed to split and thereafter concentrate forces from incoming fluidic materials to effect expansion of the cavity and thereby flatten the ogival walls upon penetration of a target area.

2. A bullet as claimed in claim 1, wherein the rib members are formed to provide flute areas therebetween, said flute areas thereby collecting fluidic materials to concentrate the hydraulic effect and produce uniform expansion of the ogival end after entry into a target of such material whereby to flatten said end.

3. A bullet as claimed in claim 1, wherein the rib members are triangular and wedge-shaped and extend longitudinally inwardly in said cavity a substantial distance.

4. A bullet as claimed in claim 3, wherein the rib members are triangularly wedge-shaped in cross-section, and the apices thereof are substantially parallel to the axis of the cavity.

5. A bullet as claimed in claim 4, wherein the rib members are of triangular wedge-shaped cross-section, and each is of diminishing area beginning at the plane including the greatest area and extending from the cavity opening to the bottom of the cavity.

6. A bullet as claimed in claim 1, wherein the rib members include apices which follow an inwardly curving path from the cavity opening to positions nearest the axis thereof.

7. A bullet as claimed in claim 6, wherein the rib members are integral with the body and said members are formed with surfaces curved from their apical edges inwardly into the cavity, said apical edge commencing at the opening.

8. A bullet as claimed in claim 1, wherein the flute areas diminish in size as they extend into the cavity.

9. A bullet as claimed in claim 1, wherein the rib members are formed to produce a reaming effect during rotation in a target.

* * * * *